US005887221A

United States Patent [19]

Grace

[11] Patent Number: 5,887,221

[45] Date of Patent: Mar. 23, 1999

[54] SIGNATURE SENSING FOR OPTIMUM TONER CONTROL WITH DONOR ROLL

[75] Inventor: Robert E. Grace, Fairport, N.Y.

[73] Assignee: Xerox Corporation, Stamford, Conn.

[21] Appl. No.: 953,533

[22] Filed: Oct. 20, 1997

[51] Int. Cl.[6] ..... G03G 15/00

[52] U.S. Cl. ..... 399/49; 399/27

[58] Field of Search ..... 399/27, 30, 49, 399/53, 61, 62, 72, 258, 260; 222/DIG. 1

[56] References Cited

U.S. PATENT DOCUMENTS

| | | | |
|---|---|---|---|
| 3,409,901 | 11/1968 | Dost et al. . | |
| 3,873,002 | 3/1975 | Davidson et al. | 222/56 |
| 4,348,099 | 9/1982 | Fantozzi | 399/49 X |
| 4,468,112 | 8/1984 | Suzuki et al. . | |
| 4,502,778 | 3/1985 | Dodge et al. | 399/30 |
| 4,847,659 | 7/1989 | Resch, III . | |
| 4,908,666 | 3/1990 | Resch, III . | |
| 5,198,861 | 3/1993 | Hasegawa et al. | 399/27 |
| 5,204,698 | 4/1993 | LeSueur et al. . | |
| 5,214,476 | 5/1993 | Nomura et al. | 222/DIG. 1 |
| 5,220,373 | 6/1993 | Kanaya | 399/30 X |
| 5,402,214 | 3/1995 | Henderson . | |
| 5,581,221 | 12/1996 | Kawai et al. | 399/49 |
| 5,710,958 | 1/1998 | Raj | 399/49 |
| 5,717,978 | 2/1998 | Mestha | 399/53 X |
| 5,778,279 | 7/1998 | Kawai et al. | 399/27 X |

*Primary Examiner*—Sandra Brase

[57] ABSTRACT

Reload characteristics of a development member such as a donor roll are monitored by using a machine exposure system (ROS or LED Bar) to generate a test image composed of a short (in the process direction) high density solid area patch followed by a long mid and lower density areas (solid or halftone), the later corresponding to Reload Defect (RD) exhibited by the development member. Typical dimensions of the test image would be a 15 mm square high density patch followed by a 200×15 mm mid and lower density regions. This test image voltage profile is placed in a skipped image frame inserted into a long job, or is effected during cycle-out/down following a shorter job run, and is scheduled at infrequent periodic intervals, for example, every 2000 prints. The resultant developed toner pattern on the photoreceptor is monitored, for example, with a reflectance or transmission density sensor such as the Toner Area Coverage (TAC) sensor used in the 4700™, 4850™, and 5775™ imaging products or an Extended Toner Area Coverage (ETAC) sensor. The toner dispense rate is adjusted to obtain a desired level of Reload Defect in the developed toner patter which corresponds to the optimum level of Toner Concentration in the development system.

8 Claims, 3 Drawing Sheets

SIGNATURE SENSING FOR OPTIMUM TONER CONTROL WITH DONOR ROLL

BACKGROUND OF THE INVENTION

The present invention relates to toner (developer) supply control in electrostatographic printing/digital copying machines in which an electrostatic latent image is formed on an imaging member by a printing head and is subsequently developed with toner. The imaging member may, for example, be a photoreceptor belt and the printing head may be a laser device which directs a laser beam at the photoreceptor for imagewise discharge thereof.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to a donor roll is then deposited on a latent electrostatic images on a charge retentive surface which is usually a photoreceptor. The toner powder image is then transferred from the photoconductive member to a copy substrate. The toner particles are heated to permanently affix the powder image to the copy substrate.

To maintain print quality over the course of a job, toner concentration must be maintained during the job. This usually means adding toner to the developer housing in a controlled fashion during the entire run.

In a digital xerographic engine, the number of pixels printed can be roughly correlated to the amount of toner to be used, and hence the amount of toner which should be dispensed to maintain proper toner concentration. Printing machines in which that approach is adopted are described in U.S. Pat. Nos. 3,409,901, 4,847,659 and 4,908,666. Noted by the UK PO as relevant to the parent UK application is Canon U.S. Pat. No. 4,468,112, issued Aug. 28, 1984 to A. Suzuki, et al.

Also, particularly noted is U.S. Pat. No. 3,873,002 re the Xerox Corporation "6500" color copier toner dispensing control system.

Following is a discussion of additional prior art, incorporated herein by reference, which may bear on the patentability of the present invention. In addition to possibly having some relevance to the question of patentability, these references, together with the detailed description to follow, may provide a better understanding and appreciation of the present invention.

U.S. Pat. No. 5,204,698 granted to LeSueur et al on Apr. 20, 1993 discloses an electrostatographic laser printing/digital copying machine in which a latent image is generated on a circulating imaging member in accordance with digital image signals and subsequently developed with toner, the number of pixels to be toned is used as an indication of the rate at which toner is being depleted from the developer mixture. The device for dispensing fresh toner to the developer mixture is operated in dependence on the number of pixels to be toned so that there is a pre-established relationship between the pixel count and the length of time for which the dispensing device is in operation. If the efficiency of the dispensing device falls, the pre-established relationship is adjusted so that the toner density in the developed images remains constant. If a predetermined level of adjustment is reached, it is taken as an indication that the supply of toner in the printer is low, and should be replenished.

U.S. Pat. No. 5,402,214 granted to Thomas A Henderson on Mar. 28, 1995 discloses a toner concentration sensing system for an electrophotographic printer which system controls the concentration of the toner in developer mixture in an electrophotographic printer. Toner is applied on a test patch on a charge-retentive surface in a manner consistent with a desired toner density on a test patch, and the actual toner density on the test patch is measured. The charge applied to the charge-retentive surface is then adjusted in response to the measured actual toner density to obtain the desired toner density on a subsequent test patch. The change in charge applied to the charge-retentive surface is used to detect a shortage of toner in the developer.

Xerographic development processes which employ donor rolls, such as Hybrid Scavengeless Development, (HSD) can exhibit a print defect when localized high toner consumption depletes the available toner in one part of the donor roll surface, and the system is unable to replenish the depleted toner in one revolution of the roll. This leads to a repetitive, periodic, gradually declining "ghost" image disturbance propagating in the process direction behind the area of high consumption; this is termed the Reload Defect (RD).

One known strategy to minimize the reload defect is to bias the Toner Concentration (TC) operating point toward the high-TC side of the latitude window. This is effective on a single machine in the short term, but increases the failure frequency in a population of machines and leaves less latitude for long-term effects such as sensor drift, developer contamination, and aging of mechanical components. This strategy can also contribute to excessive dirt generation and resultant machine contamination, most likely requiring manual intervention at setup to determine a unique toner control setpoint for each machine.

A preferred strategy is to operate the xerographic process consistently at a TC level just high enough to prevent customer perception of the reload defect. This optimum TC value will differ from housing to housing due to differences in developer flow, mechanical spacings, electrostatics, developer age and state, and operating environment.

It would be desirable to effect "constant reload level" control by measuring the reload defect level during or just after customer usage, and automatically adjusting the TC setpoint to keep the system at its optimal operating point. This strategy will automatically compensate for long-term effects such as TC sensor drift and contamination, developer aging and contamination, and wear of mechanical components.

BRIEF SUMMARY OF THE INVENTION

Reload measurement pursuant to the invention is accomplished by using the machine exposure system (ROS or LED Bar) to generate a test image voltage profile composed of a short (in the process direction) high density solid area patch followed by a long mid-density region (solid or halftone). [Typical dimensions would be a 15 mm square high density patch followed by a 200×15 mm mid-density region.] This test image voltage profile is placed in a skipped image frame inserted into a long job, or is effected during cycle-out/down following a shorter job, and is scheduled at infrequent periodic intervals (for example, every 2000 prints). The resultant developed toner pattern on the photoreceptor is sensed with a reflectance or transmission density sensor; for example, the Toner Area Coverage (TAC) sensor used in the 4700™, 4850™, and 5775™ imaging products or an Extended Toner Area Coverage (ETAC) sensor.

DESCRIPTION OF THE PREFERRED EMBODIMENT(S) OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 4:
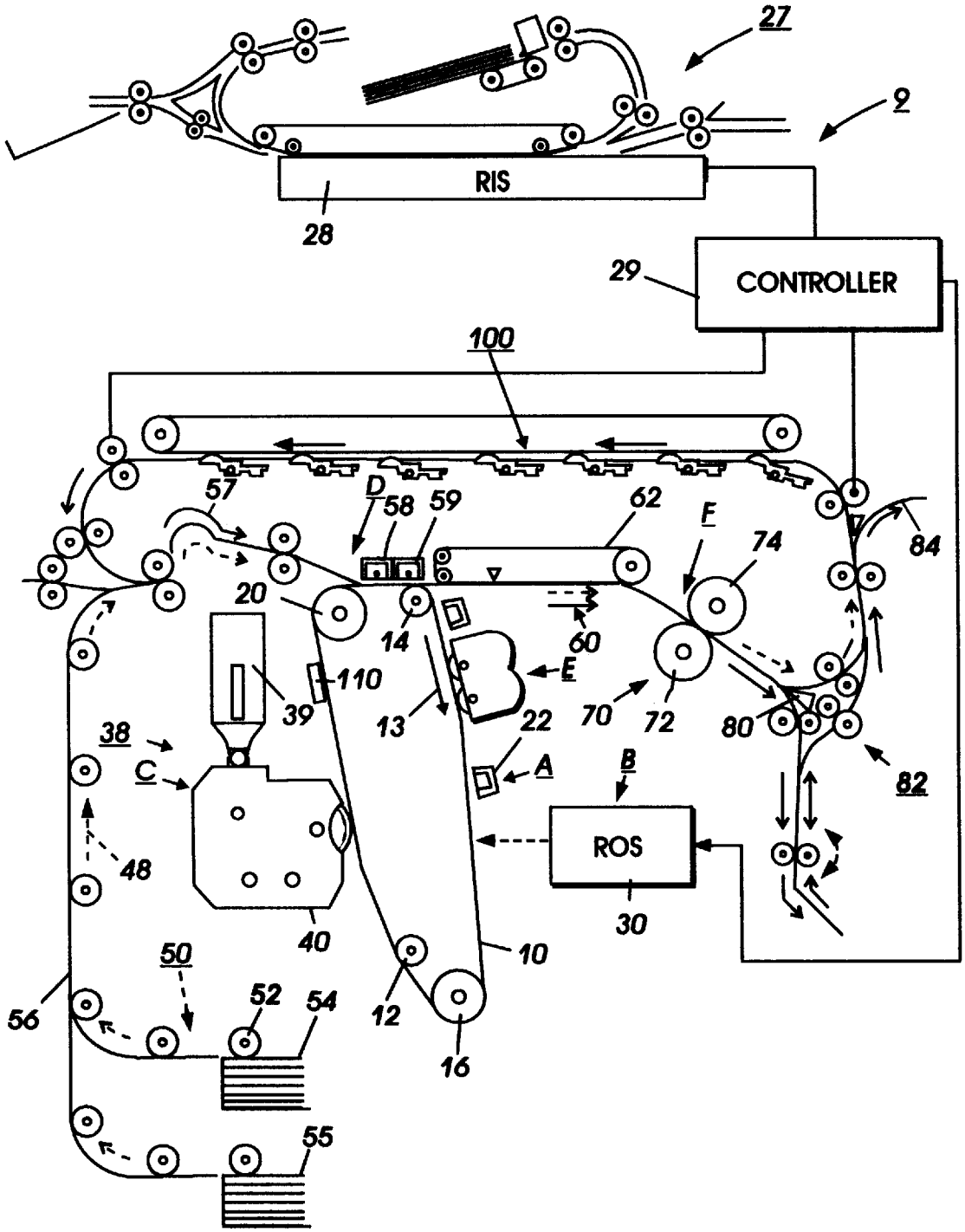
FIG. 4 is a schematic illustration of a printing machine incorporating the invention.

For a general understanding of the features of the present invention, reference is made to the drawings. In the drawings, like reference numerals have been used throughout to identify identical elements. FIG. 4 schematically depicts an electrophotographic printing machine incorporating the features of the present invention therein. It will become evident from the following discussion that the development system of the present invention may be employed in a wide variety of devices and is not specifically limited in its application to the particular embodiment depicted herein.

Referring to FIG. 4 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic SubSystem (ESS) or controller which controls a raster output scanner (ROS) described below.

FIG. 4 schematically illustrates an electrophotographic printing machine 9 which generally employs a photoconductive belt 10 for creating xerographic images. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about idler roller 12, stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or Electronic SubSystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers.

Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror block. The ROS imagewise discharges the photoconductive belt to record an electrostatic latent image thereon corresponding to the image received from ESS 29. As an alternative, ROS 30 may employ a linear array of Light Emitting Diodes (LEDs) arranged to illuminate the charged portion of photoconductive belt 10 on a raster-by-raster basis.

After the electrostatic latent image has been recorded on photoconductive belt 10 advances the latent image to a development station, C, where toner, in the form of dry marking particles, is electrostatically attracted to the latent image using the device of the present invention as further described below. The latent image attracts toner particles from a scavengeless developer apparatus resulting in a toner powder image being formed on the surface 12. As successive electrostatic latent images are developed, toner particles are depleted from the developer material. A toner particle dispenser, indicated generally by the reference numeral 39, on signal from controller 29, dispenses toner particles into a non interactive development system such as Hybrid Scavengeless Developer (HSD) system 40 of developer unit 38. Developer unit 38 comprises donor roll 41 which serves to deposit toner particles on the photoconductive surface 12. The HSD system may comprise an arrangement such as that disclosed in U.S. patent application Ser. No. 08/712,527 filed in the name of lindblad et al on Sep. 12,1996.

The developer system 40 may alternatively comprise a non interactive development system comprising a plurality of electrode wires closely spaced from a toned donor roll or belt in the development zone. An AC voltage is applied to the wires to generate a toner cloud in the development zone. The electrostatic fields associated with the latent image attract toner from the toner cloud to develop the latent image.

The donor roll 41 may also comprise an electroded donor roll structure such as that disclosed in U.S. Pat. No. 5,360,940 granted to Dan A. Hays on Nov. 1, 1994.

With continued reference to FIG. 4, after the electrostatic latent image is developed, the toner powder image present on belt 10 advances to transfer station D. A substrate 48 such as plain paper is advanced to the transfer station, D, by a substrate feeding apparatus, 50. Preferably, substrate feeding apparatus 50 includes a feed roll 52 contacting the uppermost substrate of stack 54. Feed roll 52 rotates to advance the uppermost substrate from stack 54 into vertical transport 56. Vertical transport 56 directs the advancing substrate 48 of support material into registration transport 57 past image transfer station D to receive an image from photoreceptor belt 10 in a timed sequence so that the toner powder image formed thereon contacts the advancing substrate 48 at transfer station D. Transfer station D includes a corona generating device 58 which sprays ions onto the back side of substrate 48. This attracts the toner powder image from photoconductive surface 12 to substrate 48. After transfer, substrate 48 continues to move in the direction of arrow 60 by way of belt transport 62 which advances substrate 45 device 59 positioned detack corona device 59 positioned downstream of the transfer device 58 serves to lessen the electrostatic attraction between the substrate 48 and the belt 10 to thereby facilitate stripping of the substrate 48 from the belt in the area of the stripping roller 14.

Fusing station F includes a fuser assembly indicated generally by the reference numeral 70 which permanently affixes the transferred toner powder image to the copy substrate. Preferably, fuser assembly 70 includes a heated fuser roller 72 and a pressure roller 74 with the powder image on the copy substrate contacting fuser roller 72.

As the substrates 48 pass through fuser 70 the images are permanently fixed or fused to the substrate. After passing through fuser 70, a gate 80 either allows the substrate to move directly via output 84 to a finisher or stacker, or deflects the substrate into the duplex path 100, specifically, first into single substrate inverter 82 here. That is, if the substrate is either a simplex substrate, or a completed duplex substrate having both side one and side two images formed thereon, the substrate will be conveyed via gate 80 directly to output 84. However, if the substrate is being duplexed and is then only printed with a side one image, the gate 80 will be positioned to deflect that substrate into the inverter 82 and into the duplex loop path 100, where that substrate will be inverted and then fed for recirculation back through transfer station D and fuser 70 for receiving and permanently fixing the side two image to the backside of that duplex substrate, before it exits via exit path 84.

After the print substrate is separated from photoconductive surface 12 of belt 10, the residual toner/developer and paper fiber particles adhering to photoconductive surface 12 are removed therefrom at cleaning station E. Cleaning station E includes one or more rotatably mounted fibrous brushes and a cleaning blade in contact with photoconductive surface 12 to disturb and remove paper fibers and nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described including toner dispensing. The controller provides a comparison count of the copy substrates, the number of documents being recirculated, the number of copy substrates selected by the operator, time delays, jam corrections, etc. The control of all of the exemplary systems heretofore described may be accomplished by conventional control switch inputs from the printing machine consoles selected by the operator. Conventional substrate path sensors or switches may be utilized to keep track of the position of the document and the copy substrates.

A density sensor such as an Extended Toner Area Coverage (ETAC) sensor 110 downstream of the developer unit 38 is utilized for controlling dispensing of toner from dispenser 39 in a manner to be discussed hereinafter.

It is believed that the foregoing description is sufficient for purposes of the present application to illustrate the general operation of an electrophotographic printing machine incorporating the features of the present invention therein.

Figure 1A:
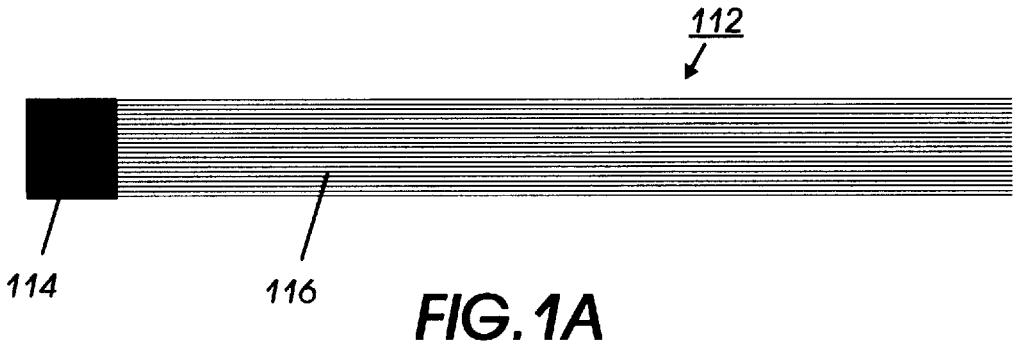
FIG. 1*a* illustrates the appearance of a test image without any Reload Defect.

A test image or patch 112 as depicted in FIG. 1*a* comprises a short (in the process direction) high density solid area 114 followed by a long mid-density region 116 (solid or halftone). In the absence of a RD, the developed image o the belt 10 will have the overall appearance of FIG. 1*a*.

Figure 1B:
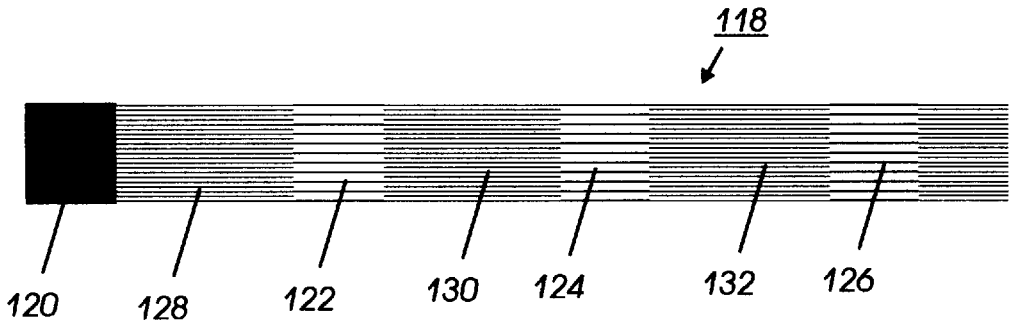
FIG. 1*b* illustrates the appearance of a test image developed exhibiting a severe Reload Defects.

When a severe Reload Defect is present, the developed on the belt 10 as depicted in FIG. 1*b* comprises a short (in the process direction) high density solid area 120 followed by a plurality of severe Reload Defect areas 122, 124 and 126 along with areas 128, 130 and 132 which do not exhibit any Reload Defect.

Figure 2:
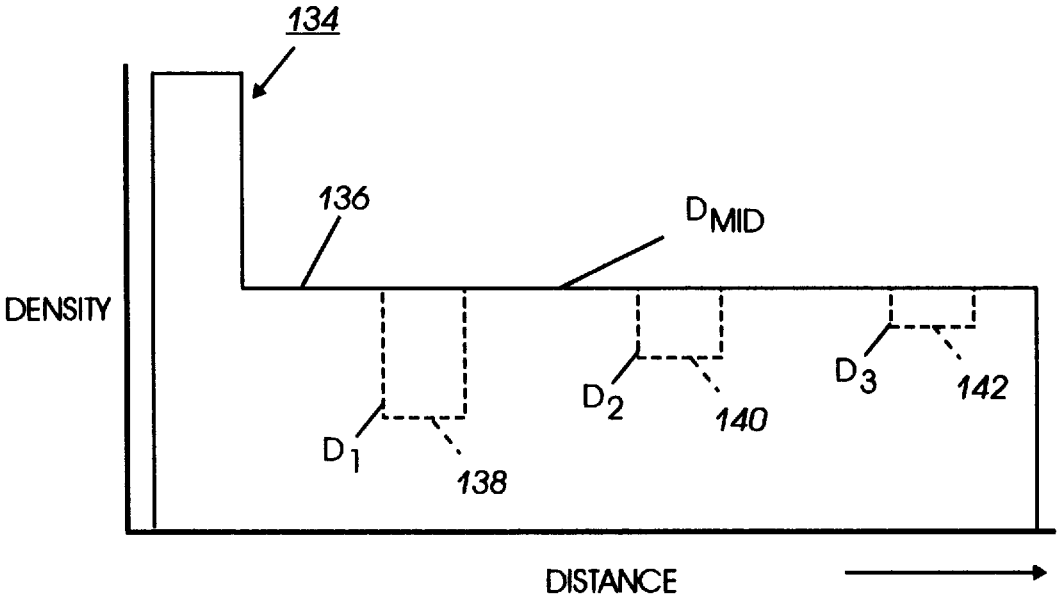
FIG. 2 illustrates schematically examples of density sensor output converted to density values for cases similar to FIGS. 1*a* and 1*b*.

FIG. 2 shows a voltage profile depicting schematically examples of the output of density sensor 110 represented by a plot 134 of density versus distance values for cases similar to FIGS. 1*a* and 1*b*. The flat line 136 of density level $D_{mid}$ representing a Midtone Density Image is equivalent to the applied image in FIG. 1*a*; that is, there is no Reload Defect (the TC is too high). Dashed lines 138, 140 and 142 at density levels $D_1$, $D_2$, and $D_3$ represent the severe Reload Defect illustrated in FIG. 1*b* (the TC is too low). The desired state is between the Midtone density level represented by reference character 136 and the Reload Defect areas 138–142.

Figure 3:
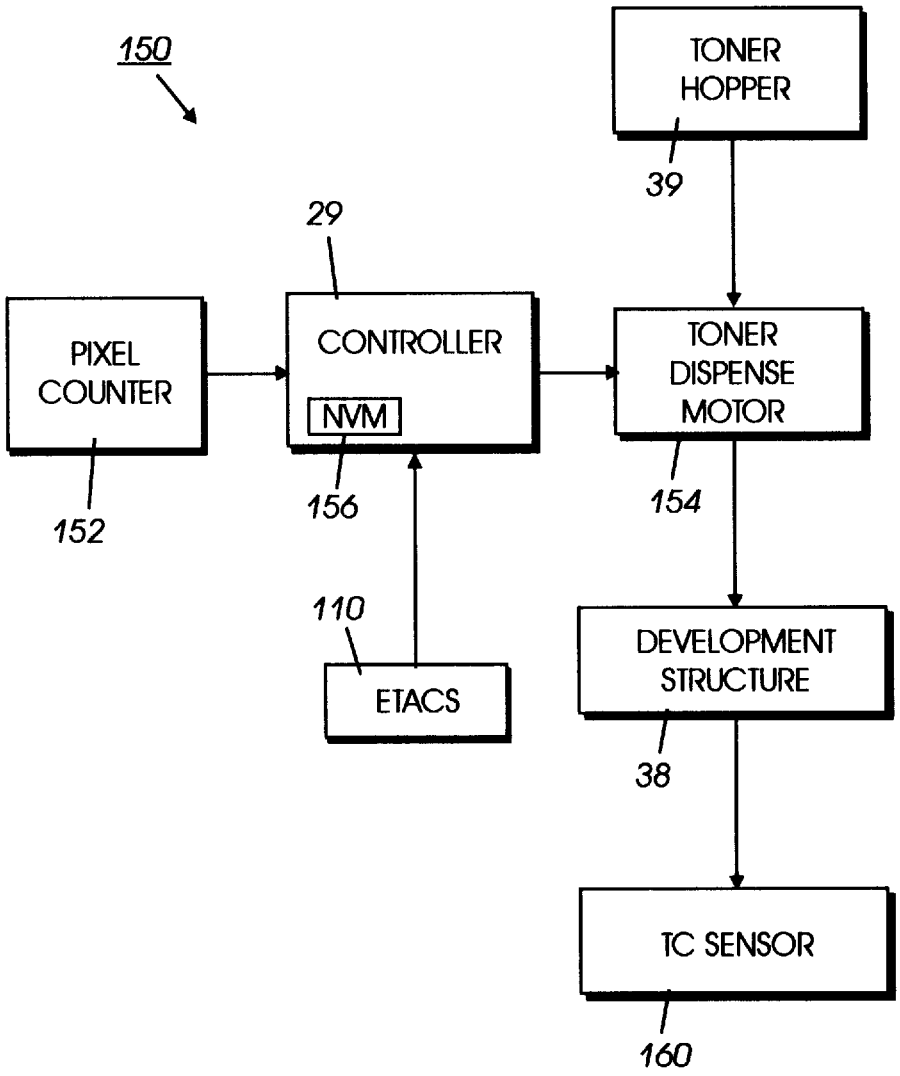
FIG. 3 is a diagram of a toner dispenser control.

A diagrammatic view of a toner dispenser control 150 depicted in FIG. 3 comprises a pixel counter 152, which generates outputs in the form of electrical signals that are transmitted to controller or ESS 29. To this end, for every cycle of the photoreceptor belt in the print mode, the number of pixels in the images to be laid down over that cycle is monitored in a conventional manner by the pixel counter 152. Outputs in the form of electrical signals representative of Reload defects are generated by the density or ETAC sensor 110 and are also transmitted to the controller or ESS 29. The controller, in turn generates outputs in the form of electrical signals for effecting actuating of a toner dispenser motor 154, the duration depending upon the signals received from the pixel counter 152 and the density sensor 110.

In one version of this invention, numeric values of the type depicted in FIG. 2 are received from the sensor 110 by the controller 29 and metrics such as defect depth and recovery rate are processed thereby. For example, we might define peak defect depth=$D_1/D_{mid}$, and recovery rate=$(D_{2-D1})/D_{mid}$. The TC control setpoint would then be adjusted based on a comparison of these computed metrics to target values stored in NonVoatile Memory (NVM) 156 forming a part of the controller 29. For example, TC might be adjusted until $D_1/D_{mid}$=0.97 resulting in a user acceptable RD. The value, 0.97 is stored in NVM 156 for comparison with signals representing the sensed value. Thus, in the absence of any RDs, toner dispensing would be controlled entirely by the information received from the pixel counter 152. When RDs occur, the control of the toner dispense motor 154 is modified accordingly.

An alternative approach would employ a pattern recognition algorithm stored in computer memory or a trained neural network to recognize the desired shape of the Density vs. Distance voltage profile or signal shown in FIG. 2. If it perceived the flat signal corresponding to the image depicted in FIG. 1*a*, it would reduce the TC setpoint. If it perceived the notched signal corresponding to the image depicted in FIG. 1*b*, it would increase the TC setpoint, until the desired intermediate signal was achieved.

It should be noted that the Reload Defect can be enhanced during the development of the test image by adjustment of development process parameters (for example, using a reduced value of $V_{dm}$, the development voltage between the magnetic brush and the donor roll). In this case, the a value to be used for $V_{dm}$ is obtained from a lookup table forming a part of the controller depending on the signals produced by the sensor 110. In this manner, the sensitivity of defect depth and recovery rate to TC can be increased and can enable more accurate measurement and more precise control while at the same time preventing the reload defect from appearing in customer images.

This approach to TC control can be applied to a monochrome or full color copier or printer. The process of Reload Defect measurement and TC adjustment is repeated for each color (including black) resident in the machine, at a rate dependent upon the usage of that color. TC control between measurements is accomplished with a conventional closed-loop system employing, for example the TC sensor 160 and pixel counter 152 as inputs to the toner dispense or toner motor operating decision. The setpoint of this control loop is adjusted based on the reload defect level evaluation.

An alternative enabled by this invention is the elimination of the conventionally used TC sensor. If the reload defect sampling interval is reduced to a few hundred prints, the error in dispense based only on pixel counting during that short interval is low enough that the TC sensor becomes redundant. This enables a tradeoff of productivity vs. cost; a long sampling interval with a TC sensor, or more frequent interruptions for reload defect sampling without a TC sensor and the consequent cost reduction.

Whichever of the various described implementation strategies is chosen, the net result is automatic compensation for sources of long-term drift in the TC control loop, and a consequent reduction in service frequency and improvement in customer satisfaction arising from stable image quality. Another significant benefit is a reduction in xerographic setup time arising from the ability to seek the optimal TC operating point directly, rather than seeking the boundaries of the latitude space and then returning to the center.

No incremental sensor Unit Manufacturing Cost (UMC) is required because the density sensor is already present in all digital copier and printer designs in which use of this control approach is contemplated.

I claim:

1. Image creation apparatus, said apparatus comprising:

a circulation change retentive surface;

means for uniformly changing said charge retentive surface;

exposure means for imagewise discharging said uniformly charged charge retentive surface for forming latent electrostatic images in the form of a test patch voltage profile on said charge retentive surface, said test patch voltage profile being formed in the direction of circulation of said charge retentive surface and comprising a short high density solid area followed by a longer mid and low density solid area;

a non interactive development system for developing said test patch voltage representing development characteristics of said development system, a toner dispenser for replenishing toner in said development system;

motor means for effecting operation of said toner dispenser;

means for monitoring said developed test patch and generating an electrical output corresponding to a developed density;

means for comparing said electrical output to a value stored in memory which corresponds to the speed of a toner dispenser motor; and means responsive to said means for comparing for adjusting the operation of said motor means when said output from said means for comparing differs form said stored value.

2. Apparatus according to claim 1 wherein said voltage profile is about 15 mm square in the high density solid area and an of about 200×15 mm containing mid and lower density areas.

3. Apparatus according to claim 2 wherein said voltage profile is created periodically in a skipped image frame inserted into a long job.

4. Apparatus according to claim 1 wherein said means for comparing comprises a pattern recognition algorithm device.

5. Method of image creation apparatus, said method including the steps of:

circulating a charge retentive surface;

uniformly charging said charge retention surface;

imagewise discharging said uniformly charged charge retentive surface for forming a latent electrostatic image in the form of a test patch voltage profile on said charge retentive surface, said test patch voltage profile being formed in the direction of circulation of said charge retentive surface and comprising a short high density solid area followed by a longer mid and low density solid area;

using a non interactive development system, developing said test patch voltage profile for providing development characteristics of said development system, replenishing toner in said development system by a toner dispenser;

effecting operation of said toner dispenser by a motor means;

monitoring said developed test patch and generating an electrical output corresponding to developed density;

comparing said electrical output to a value stored in memory which corresponds to the speed of said toner dispenser motor; and adjusting the operation of said motor means in response to said comparing step when said electrical output differs from said stored value.

6. The method according to claim 5 wherein said voltage profile is about 15 mm square in the high density solid area and an of about 200×15 mm containing mid and lower density areas.

7. The method according to claim 6 wherein said voltage profile is created periodically in a skipped image frame inserted into a long job.

8. The method according to claim 5 wherein said value stored in memory comprises a pattern recognition algorithm.

* * * * *